US005933979A

United States Patent [19]

Wedel

[11] Patent Number: 5,933,979

[45] Date of Patent: Aug. 10, 1999

[54] RESTRAINT DRYER FOR THE DRYING END OF A PAPERMAKING MACHINE AND A METHOD THEREOF

[75] Inventor: Gregory L. Wedel, Beloit, Wis.

[73] Assignee: Beloit Technologies, Inc., Wilmington, Del.

[21] Appl. No.: 08/961,615

[22] Filed: Oct. 31, 1997

[51] Int. Cl.[6] ..... D21F 5/00

[52] U.S. Cl. ..... 34/446; 34/117; 34/124

[58] Field of Search ..... 34/446, 452, 456, 34/458, 117, 119, 124, 125; 162/358.2, 358.3, 359.1

[56] References Cited

U.S. PATENT DOCUMENTS

| | | | |
|---|---|---|---|
| 4,876,803 | 10/1989 | Wedel | 34/117 |
| 4,905,379 | 3/1990 | Wedel | 34/452 |
| 4,934,067 | 6/1990 | Wedel | 34/457 |
| 5,063,689 | 11/1991 | Sollinger . | |
| 5,065,529 | 11/1991 | Skaugen et al. . | |
| 5,248,390 | 9/1993 | Fissmann et al. . | |
| 5,269,074 | 12/1993 | Sims et al. . | |
| 5,269,075 | 12/1993 | Brunnmair et al. . | |
| 5,319,863 | 6/1994 | Kotitschke et al. . | |
| 5,321,899 | 6/1994 | Kade et al. . | |
| 5,551,164 | 9/1996 | Brunnmair et al. | 34/117 |
| 5,600,897 | 2/1997 | Sollinger et al. . | |

FOREIGN PATENT DOCUMENTS

| | | |
|---|---|---|
| 40 24 955 A1 | 2/1992 | Germany . |
| 83/00514 | 2/1983 | WIPO . |

OTHER PUBLICATIONS

Patent Application No. 08/657,754 filed May 30, 1996 entitled "Curl Control With Dryer Aircaps".

Patent Application–Papermaking Dryer with Pivoting Vacuum Transfer Rolls Application No.: 08/740,136.

*Primary Examiner*—Henry A. Bennett
*Assistant Examiner*—Steve Gravini
*Attorney, Agent, or Firm*—Lathrop & Clark LLP

[57] ABSTRACT

A drying section in a papermaking machine has a first section with a series of single-tiered drying cylinders having vacuum transfer rolls with external vacuum chambers therebetween for improving web runnability, and a second dryer section with a series of single-tiered drying cylinders having movable vacuum transfer rolls disposed therebetween for providing improved cross-directional web shrinkage restraint.

13 Claims, 2 Drawing Sheets

RESTRAINT DRYER FOR THE DRYING END OF A PAPERMAKING MACHINE AND A METHOD THEREOF

FIELD OF THE INVENTION

The present invention relates to a drying apparatus and method for drying a web of paper. More particularly, the present invention relates to a drying apparatus comprising two drying sections.

BACKGROUND OF THE INVENTION

In the manufacture of lightweight paper grades, such as newsprint and fine paper, the web is dried on a series of steam-heated drying cylinders. To dry the web, it is pressed directly onto the cylinders by a series of tensioned, permeable dryer fabrics or felts.

In a conventional double-felted, two tier dryer section, the wet web passes from one cylinder to the next in a generally serpentine fashion through lengthy zones in which the web is unsupported, called "open draws." The majority of water vapor that leaves the web during drying is released in these open draws. The use of open draws, however, is associated with numerous problems relating to runnability and web quality. First, the web tends to flutter in the open draws. Second, dryers utilizing open draws typically require threading ropes in order to thread a tail of the web through the dryer sections. Finally, the use of open draws results in web quality problems. The web, which is unrestrained in the cross-machine direction in the open draws, tends to shrink, particularly at the edges, as water evaporates from the web. This shrinkage is non-uniform, and results in such web surface defects as curl, cockle, and graininess.

Some of the problems with web flutter and sheet shrinkage have been solved by using single-tiered dryer sections alone or in combination with double-tiered dryer sections. In a single-tiered dryer section, such as those in the BelRun™ and Bel-Champ™ dryers manufactured by Beloit Corporation of Beloit, Wis., the web moves from one drying cylinder to another by passing around a transfer roll, supported by a felt. Thus, in the zones between the cylinders and transfer rolls, the web is directly supported by the felt. This is known as a "closed draw." The use of a closed draw has improved runnability by reducing web flutter and eliminating the need for threading ropes. Drying of both sides of the web is achieved by passing the web between alternating top-felted and bottom-felted sections. The web is transferred between these sections using a unique felt arrangement, such as that shown in U.S. Pat. No. 4,934,067.

In the single-tiered dryer sections, sheet restraint is provided using the combination of felt pressure against the web on the cylinders, and vacuum pressure against the web on the transfer rolls between the cylinders, caused by the formation of a partial vacuum at the surface of the transfer rolls. Transfer rolls designed to form such a vacuum are appropriately known as vacuum transfer rolls. The use of such vacuum transfer rolls in all the drying sections of a drying apparatus has been shown to reduce cross-directional web shrinkage by 60 to 80 percent.

The use of single-tiered dryer sections has not, however, fully solved the runnability or web shrinkage problems. Occasionally, the wet web will separate from the felt. Such separation generally occurs in the zone, or distance, between the dryer cylinder and the vacuum transfer roll. This zone, or distance, is known as the "down run." Although the "down run" is generally short, less than 18 to 20 inches, and represents a direct path from the dryer cylinder to the vacuum roll, the web can separate from the felt due to adhesive forces between the web and the dryer cylinder on the cylinder surface. This separation is often related to incorrect or uncontrolled chemistry in the stock preparation, forming or pressing areas, or incorrect or uncontrolled airflows.

To solve the web separation problem, various sealing mechanisms have been combined with the vacuum transfer rolls so that a partial vacuum is created in the region between adjacent cylinders bounded by the felt extending between the two cylinders and the transfer roll. This region is known as the "pocket." This partial vacuum against the felt on the side opposite to that which carries the web, urges the web against the felt in the down runs. Such a design is shown, for example, in U.S. Pat. No. 4,876,803 ("the '803 patent"). The '803 patent discloses a vacuum transfer roll with a perforate shell in combination with sealing means comprising a wedge-shaped box disposed within the pocket. As stated above, a partial vacuum is created in the pocket, causing the web to be urged against the felt, thus resisting separation in the down run.

Such a design has been found to be more effective in reducing web separation than the use of a conventional dryer section with the vacuum transfer rolls located the usual two to six inches from the dryers. The vacuum level achieved in the pocket areas, however, is generally insufficient to completely restrain the web from cross-directional shrinkage. The maximum practical vacuum that can be achieved in the pocket areas is limited by felt deflection, leakage from the sealing means, felt wear, operating costs involved in creating the vacuum, and the tendency for broke to accumulate on the sealing means, resulting in damage, such as burning, to the felt.

In addition, the partial vacuum applied against the felt in the "down-run" is applied when the web and felt are in a generally flat orientation. Much higher vacuum levels are required to restrain the web when it is flat than is required when the web is wrapping around the vacuum transfer roll. Thus, although the use of vacuum transfer rolls combined with pocket sealing means, such as vacuum transfer rolls having external vacuum chambers, to create a partial vacuum against the felt in the down run has reduced web separation and thus improved runnability, it is not particularly effective in preventing cross-directional shrinkage.

It has been proposed to reduce cross-directional web shrinkage by reducing the length of the down run, or distance between the vacuum transfer roll and its adjacent drying cylinders. By reducing the length of the down run, the amount of time the web is in a flat orientation is reduced. Such a reduction in down run length has been accomplished by the use of pivoting vacuum transfer rolls. Pivoting vacuum transfer rolls, such as those disclosed in U.S. Pat. No. 4,905,379, are capable of reducing the down run length during operation of the dryer by reducing the gap between the dryer and following vacuum transfer roll to a distance of no more than about 0.5 inches to about 1 inch. However, the use of pivoting vacuum rolls does not result in the improved runnability obtained from the use of vacuum rolls with external vacuum chambers to create a partial vacuum in the pocket against the side of the felt opposite that on which the web is carried.

Thus, there is a need for a paper web drying apparatus that exhibits both improved runnability and improved cross-directional web shrinkage restraint.

SUMMARY OF THE INVENTION

The paper web drying apparatus of the present invention achieves both advantageous threading ease and restricted cross-machine direction web shrinkage, by employing different transfer apparatus between dryer cylinders at the wet end and the dry end of the drying section. Advantageous threading and runnability is achieved at the wet end, where paper web characteristics are most demanding, by using vacuum chamber vacuum rolls for transfer between dryer cylinders. Downstream of the wet end, at the dry end of the dryer section, advantageous cross-machine direction shrinkage is achieved by employing movable vacuum rolls for transfer between dryer cylinders. The drying section of the present invention thus comprises a first single-tiered dryer section and a second single tiered dryer section, each having a series of drying cylinders. In the first dryer section, the web, carried by a felt, passes from one drying cylinder to the next by passing around a vacuum transfer roll with an external vacuum chamber. The vacuum transfer roll with external vacuum chamber is designed in such a way that in the pocket between the vacuum roll and the cylinders, a partial vacuum is created against the felt on the side opposite to that on which the web is carried, thereby urging the web towards the felt in the down runs. The second dryer section, through which the web travels subsequent to its passage through the first dryer section, comprises a series of drying cylinders, with movable vacuum transfer rolls between each pair of cylinders. In operation, the web passes from one cylinder to the next by passing around the movable vacuum roll, the vacuum roll being disposed so that there is substantially no down run between the vacuum roll and the cylinder.

It is a feature of the present invention to provide a paper drying apparatus exhibiting improved web runnability.

It is also an feature of the present invention to provide a paper drying apparatus exhibiting improved cross-directional web shrinkage resistance.

It is a further feature of the present invention to provide both improved runnability and improved cross-directional web shrinkage resistance in a single drying apparatus.

It is another feature of the present invention to provide a paper web drying apparatus with maximized runnability and cross-directional web shrinkage restraint.

Further objects, features and advantages of the invention will be apparent from the following detailed description when taken in conjunction with the accompanying drawings.

DESCRIPTION OF THE PREFERRED EMBODIMENT

Figure 1:
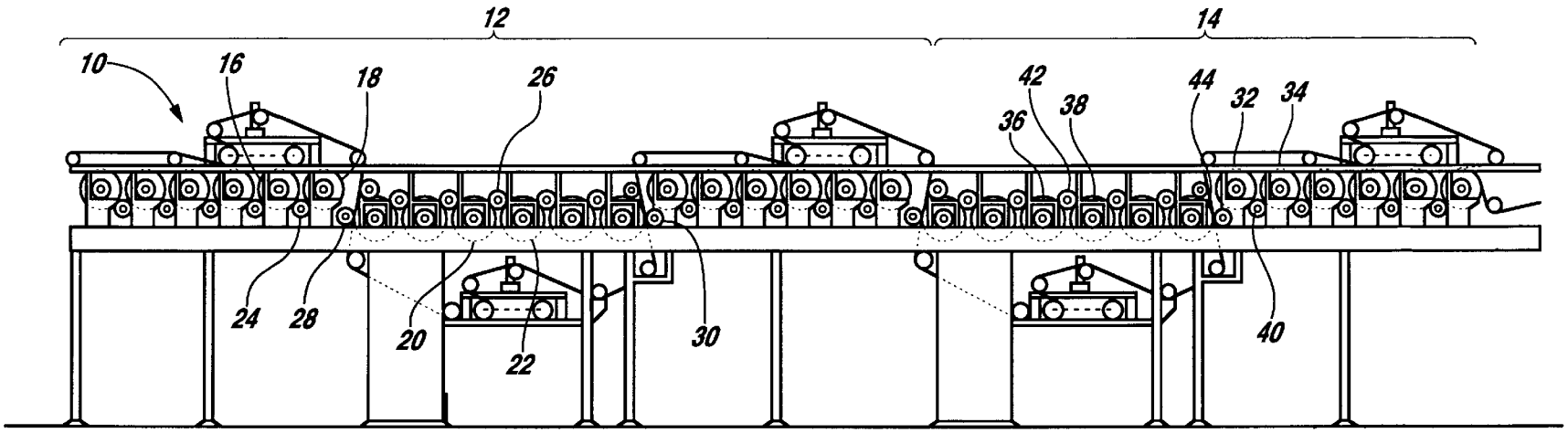
FIG. 1 is a side elevational view of the paper web drying apparatus of the present invention.

Referring more particularly to FIGS. 1–4, wherein like numbers refer to similar parts, a single-tiered web drying apparatus 10 is shown in FIG. 1. The Apparatus 10 is a portion of a papermaking machine and comprises two dryer sections: a first dryer section 12 comprising the "wet end" of the drying apparatus, and a second dryer section 14, located downstream of the first dryer section 12 and comprising the "dry end" of the apparatus 10. The first dryer section 12 comprises a plurality of top felted drying cylinders 16 and 18, and a plurality of bottom-felted drying cylinders 20 and 22, with each pair of cylinders 16, 18 and 20, 22 having a vacuum transfer roll 24, 26 with an external vacuum chamber disposed therebetween. The paper web is transferred from a series of top-felted cylinders 16, 18 to a series of bottom felted cylinders 20, 22, and vice versa, at transfer points 28 and 30.

Like the first dryer section 12, the second dryer section 14 also comprises a plurality of top-felted drying cylinders 32 and 34, and a plurality of bottom-felted cylinders 36 and 38. Each pair of cylinders 32 and 34, and 36 and 38 has a movable vacuum transfer roll 40, 42 disposed therebetween, respectively. Again, the paper web is transferred from a series of bottom-felted cylinders 36, 38 to a series of top-felted cylinders 32, 34 at transfer point 44.

Figure 2:
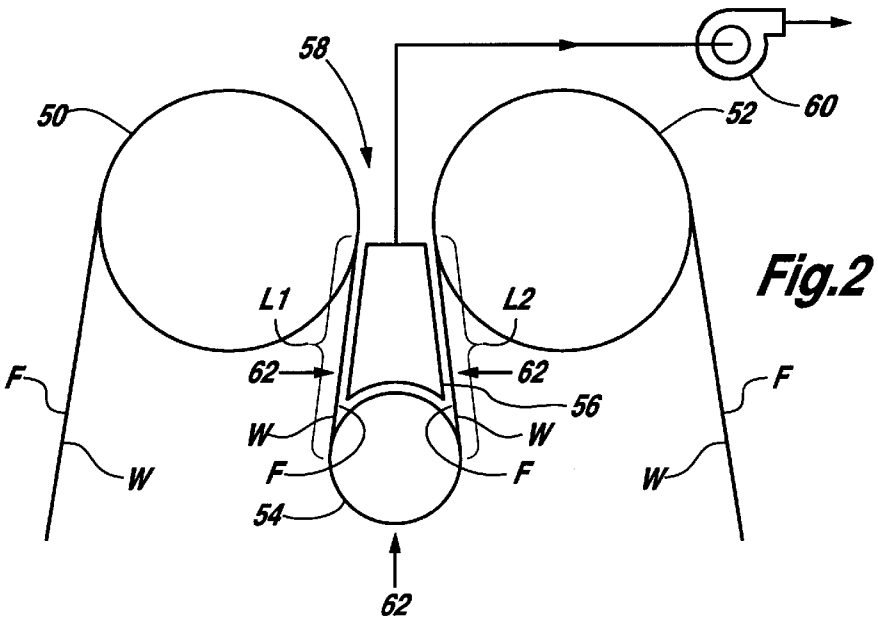
FIG. 2 is an enlarged view of a portion of the first dryer section of the apparatus of FIG. 1, showing two drying cylinders having a vacuum transfer roll with an external vacuum chamber disposed therebetween.

Two top-felted dryer cylinders 50, 52 in the first dryer section 12 are shown somewhat schematically in FIG. 2. A dryer felt F extends around the cylinder 50 such that a web W is disposed between the felt F and the cylinder 50 for drying the web W. A vacuum transfer roll 54 having a perforate shell or surface is disposed downstream relative to cylinder 50 such that the web W and felt F extend contiguously from the cylinder 50 to and around the transfer roll 54 so that the felt F is disposed between the web W and the roll 54 during transit around the roll 54. The dryer cylinder 52 is disposed downstream relative to transfer roll 54, such that the web W and the felt F extend contiguously from the transfer roll 54 to and around the cylinder 52 so that the web W is disposed between the felt F and the cylinder 52 during transit of the web W and felt F around the cylinder 52.

As the web W and felt F pass from the cylinder 50 to the transfer roll 54, there is a distance L1, in which the felt F and web W are not in contact with either the cylinder 50 or the roll 54. This distance, L1 is defined as the "down run." Likewise, as the web W and felt F pass from the roll 54 to the cylinder 52, there is a second distance L2, or second down run, in which the web W and felt F are not in contact with either the transfer roll 54 or the cylinder 52. Sealing means generally designated 56 are disposed within a pocket 58 defined by the felt F and the transfer roll 54. A vacuum fan 60 is connected to the vacuum transfer roll 54 for creating a partial vacuum in vacuum roll 54 and the pocket 58. By virtue of the partial vacuum against the side of the felt F opposite that on which the web W is carried, the web W is urged against the felt in the direction of arrows 62 in the down runs and as the web W passes around the roll 54.

Although the vacuum transfer roll 54 and the sealing means 56 may be constructed in many different ways, as desired by the user, it is preferred that they be constructed in accordance with the disclosure of U.S. Pat. No. 4,876,803, which is specifically incorporated by reference herein.

Figure 3:
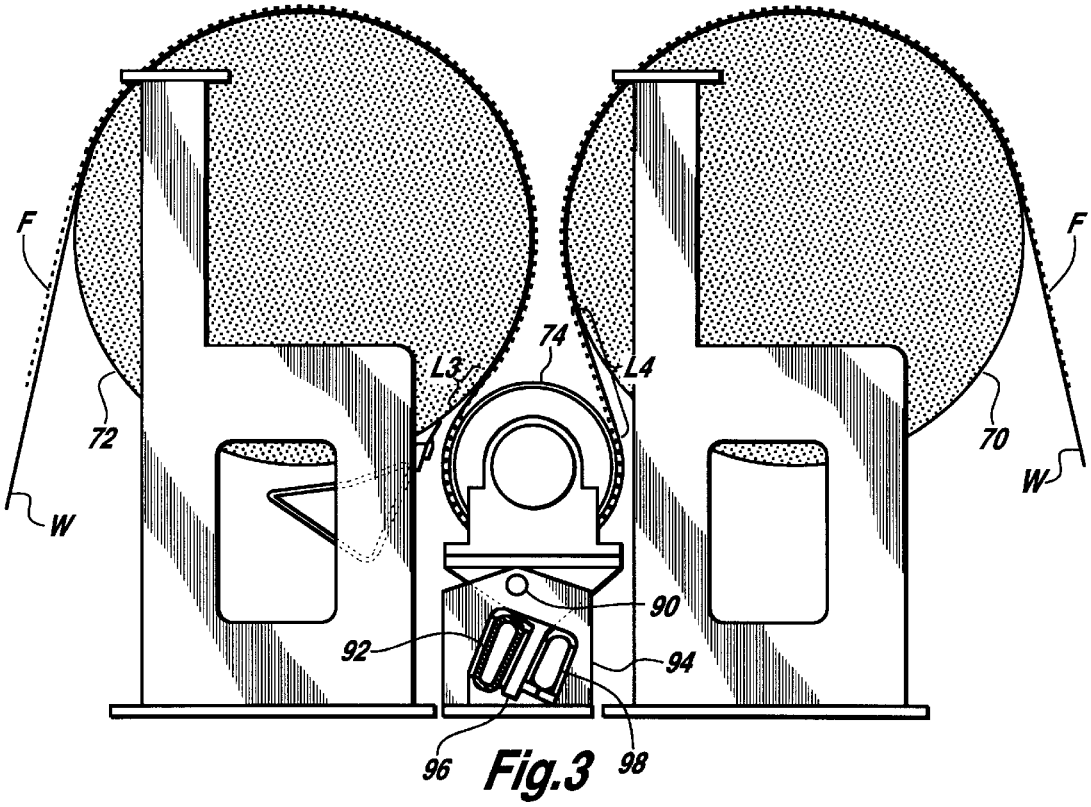
FIG. 3 is an enlarged fragmentary view of a portion of the second dryer section of the apparatus of FIG. 1, showing two drying cylinders having a movable vacuum transfer roll disposed therebetween in an operable first location.

A portion of the second dryer section 14 is shown in FIG. 3. A felt F extends around the dryer cylinder 72 such that the web W is disposed between the felt F and the cylinder 72 for drying the web W. A movable vacuum transfer roll 74 is disposed downstream relative to the cylinder 72 such that the web W and felt F extend contiguously from the cylinder 72 to and around the roll 74 so that the felt F is disposed between the web W and the roll 74 during transit of the web W and felt F around the roll 74. A dryer cylinder 70 is disposed downstream relative to the roll 74 such that the web W and the felt F extend contiguously from the transfer roll 74 to and around the downstream cylinder 70, so that the web W is disposed between the felt F and the cylinder 70 during transit around the cylinder 70.

As the web W and felt F pass from the upstream cylinder 72 to the transfer roll 74, and from the transfer roll 74 to the downstream cylinder 70, there are distances L3 and L4 respectively, or "down runs," in which the web W and felt F are not in contact with transfer roll 74 or the cylinders 70, 72. The transfer roll 74 is movable from a first location, shown in FIG. 3, to a second location, shown in FIG. 4. In the second location, the down run L5 is larger than the down run L3. The first location is chosen such that there is substantially no down run between the transfer roll and the cylinders. For the purposes of this invention, the phrase "substantially no down run" means down runs corresponding to a gap between the surfaces of the vacuum transfer roll and the dryer cylinder of less than about 1.0 inch. By having substantially no down run between the transfer rolls and the cylinders in the second dryer section, cross-directional web shrinkage is minimized.

Where d is the draw length measured from where the web departs the dryer roll to where the web engages the vacuum transfer roll g is the gap between the surfaces of the vacuum transfer roll and the dryer cylinder R is the dryer roll radius r is the vacuum transfer roll radius the length of the down run d can be expressed as a function of the gap distance and the roll radii as follows:

$$d = \sqrt{g^2 + 2g(R + r)}$$

For example, where R=3 feet, and r=1 foot, for a gap of 1 inch, the down run is 9.849 inches; for a gap of 0.5 inches, the down run is 6.946 inches; for a gap of 0.25 inches, the down run is 4.905 inches; for a gap of 0.125 inches, the down run would be 3.466 inches; and for a gap of 0.06, the down run would be 2.401 inches. Nonetheless, there are certain limiting considerations as to how small the down run can be made. For example, the dryer fabric or felt is approximately 0.060 inches thick, and hence gaps of such a size would not permit any space between the rolls. In general, the smallest practical gap is about 0.25 inches. Any of these situations, in which the down run is less than 10 inches would constitute substantially no down run.

Figure 4:
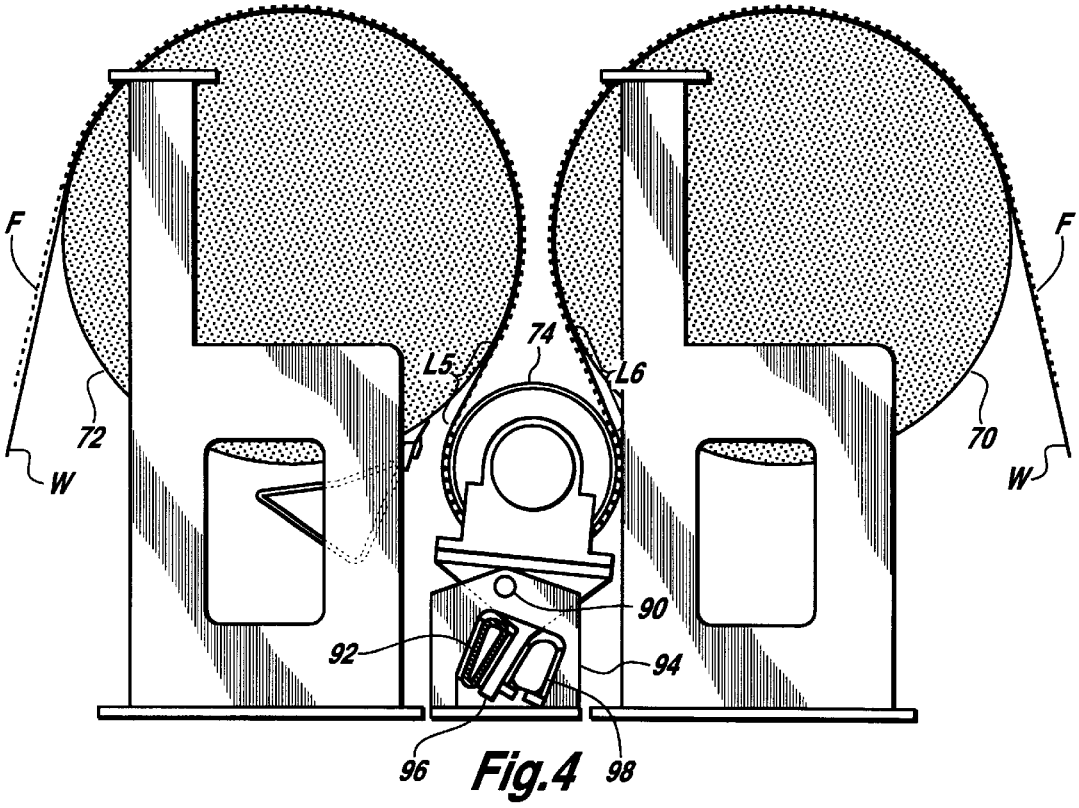
FIG. 4 is an expanded view of the portion of the second dryer section of FIG. 3, with the movable vacuum transfer roll disposed therebetween in a retracted second location.

During normal operation of the drying apparatus of the present invention, the vacuum transfer roll 74 is located in the first position as shown in FIG. 3, so that there is substantially no down run between the transfer roll and the cylinders. In the event of web breakage, the roll 74 is moved to the second location, as shown in FIG. 4, so that if the web begins to wrap around the cylinder 72, damage to the cylinder 72 and transfer roll 74 is inhibited.

The movable vacuum transfer roll 74 may be translatable vertically, but in a preferred embodiment, the vacuum transfer roll 74 is pivotable about an axis 90 which is positioned below the axis of the roll 74. An inflatable actuator 92 is inflated, as shown in FIG. 3, to position the transfer roll 74 in the first position. The actuator 92, shown in section in FIG. 3, extends between a machine frame 94 and a pivot mount 96 to which the vacuum transfer roll is pivotablly mounted. The actuator 92 is inflated to hold the vacuum transfer roll 74 in the first position for continuous running of the machine. A second actuator 98 is positioned between the machine frame 94 and the pivot mount 96 on the opposite side from the first actuator 92. The second actuator 98 is inflated and the first actuator 92 is deflated when it is desired to pivot the transfer roll 74 into the second position.

The pivot axis is preferably located directly beneath or approximately beneath the cylindrical axis of the transfer roll. The effect of this positioning of the pivot axis is that the pivoting of the transfer roll does not dramatically affect the length of the felt. Hence, the length of the felt does not change by a large amount with the pivoting. This benefit is especially realized when there are a number of transfer rolls in a single felt run, each one requiring extra felt when the rolls are pivoted away. By keeping the amount of extra felt needed to a minimum the demands on the felt stretchers is greatly reduced. Alternatively, the pivot point could be located on the frame at a position approximately directly above the axis of the transfer roll.

The transfer roll is preferably positioned so that there is over 180 degrees of roll wrap. By wrapping the felt by more than 180 degrees the possibility that the web will run off the transfer roll is greatly reduced. Even if there is a certain amount of twisting of the roll in the pivoting, it should not significantly change the tracking of the felt and web. Because the pivoting rolls are not pinned or fixed in the first position, but are instead held in position by the inflatable pneumatic actuators, should the web wrap the dryer roll or a wad of paper reach the interface between a dryer roll and the vacuum transfer roll and begin to exert excessive forces, the transfer roll will be urged into the open position thereby allowing the web wrap or wad to pass through without damage to either roll.

It has been found that cross-directional web shrinkage is minimal until the web reaches a critical moisture content. Thus, since the second dryer section is designed to minimize cross-directional web shrinkage, it is preferred that the web enter the second dryer section at or slightly prior to the time that the web attains its critical moisture content. The specific moisture level at which cross-directional shrinkage occurs differs for different grades of paper, depending on the various properties of the pulp from which the web is made. These properties dictate the resultant web wet and dry strengths, the shrinkage tendency, and the point at which unrestrained cross-directional shrinkage begins. Generally, however, cross-directional shrinkage begins when the web has a dryness of about 65 percent to about 80 percent.

For purposes of the present invention, the critical web moisture content at which unrestrained cross-directional shrinkage occurs is based on the water retention value ("WRV") of the pulp. Pulps with higher WRVs will begin to shrink at a much lower web dryness than pulps with lower WRVs, and such shrinkage will be of a larger magnitude. The critical web moisture content for unrestrained webs of various papers types has been measured and reported in "Effect of Water Retention Value (WRV) on the Paper Web Drying Process," by K. Przybysz and J. Czechowski in Cellulose Chem. Technology, Volume 20, pages 451–464 (1986). The equation for the critical moisture content (web dryness) for unrestrained drying given in that article is M=81−0.246(WRV), where WRV is the water retention value expressed in percent, and M is the critical moisture content at which shrinkage begins, expressed in percent dryness.

However, it should be noted that the critical moisture content for a partially restrained web will be higher. Applicants have discovered that in the apparatus of the present invention, the critical moisture content should be ascertained by the equation $M_1$=101−0.246 (WRV), where W is the water retention value expressed in percent, and $M_1$ is the critical moisture content at which shrinkage begins, expressed in percent dryness.

Thus, in the practice of the method of the present invention, it is preferred, for a given web, that said web enter the second dryer section at a time at or slightly before it reaches its critical moisture content M, as determined by the equation M=81−0.246(WRV), or more preferably at or slightly before the time the web meets its critical moisture content $M_1$, as determined by the equation $M_1$=101−0.246 (WRV). Practice of the method of the present invention in the above more preferred manner will result in the optimum balance of improved runnability and minimized cross-directional web shrinkage.

It is understood that the invention is not limited to the particular construction and arrangement of parts herein illustrated and described, but embraces such modified forms thereof as come within the scope of the following claims.

I claim:

1. A drying apparatus for drying a web of paper, comprising a first drying section for drying the web, said first drying section comprising:

a plurality of dryer cylinders disposed in a single tier configuration;

a plurality of vacuum transfer rolls, each vacuum roll being disposed between adjacent cylinders of said plurality of cylinders, in a location defining a down run between each cylinder and each transfer roll, a dryer fabric extending alternately around each dryer and each vacuum roll, thereby defining a pocket bounded by the fabric and the vacuum roll;

means for providing a partial vacuum in the pocket, thereby urging the web against the fabric in the down runs; and a second drying section for drying the web disposed downstream to said first drying section; said second drying section comprising:

a plurality of dryers disposed in a single tier configuration;

a plurality of vacuum transfer rolls, each vacuum transfer roll being disposed between adjacent dryers of said plurality of dryers;

a dryer fabric extending alternately around each dryer and each vacuum roll, the dryer fabric defining a required length; and each of said vacuum transfer rolls define an upstream dryer and a downstream dryer with respect to each vacuum transfer roll, each vacuum transfer roll being pivotally mounted about a pivot axis which is spaced from the axis of each roll approximately in a vertical cross machine direction plane, and thus movable from a first location closely spaced from the upstream dryer to a second location spaced from the first location and closer to the downstream dryer, said first location being such that there is substantially no down run between each upstream dryer and downstream vacuum roll, and said second location being farther away from said upstream dryer than said first location and closer to said downstream dryer then the first location, wherein pivoting of the transfer rolls does not result in substantial vertical movement and thus does not cause substantial change in the required length of the dryer fabric.

2. The dryer apparatus of claim 1 wherein the pivot point is located approximately below the axis of the vacuum roll.

3. The dryer apparatus of claim 1 wherein the each transfer roll is resiliently biased for motion about its pivot point by a pair of opposed inflatable actuators which provide resilient biasing so that the transfer roll can be urged open against one of said inflatable actuators.

4. The dryer apparatus of claim 1 wherein each transfer roll is positioned so that the dryer fabric wraps each transfer roll by at least 180 degrees thus reducing the tendency for the web to run off each transfer roll.

5. A method for drying a web of paper, comprising:

guiding the web through a first dryer section, comprising a plurality of dryer cylinders arranged in series along the path of the web through the first dryer section;

a plurality of vacuum transfer rolls, each vacuum roll being disposed between adjacent cylinders of said plurality of cylinders;

a dryer fabric extending alternately around each dryer and each vacuum roll in a manner such that the web is disposed between the fabric and said dryer cylinders during transit around said dryer cylinders, and the fabric is disposed between said vacuum rolls and said web during transit around said vacuum rolls, the dryer fabric defining a required length;

maintaining a partial vacuum in a pocket disposed between adjacent dryer cylinders, and bounded by the fabric and the vacuum roll, such that the web is urged against the fabric in the down runs; and subsequently guiding the web through a second dryer section, said second dryer section being disposed downstream of said first dryer section, and said second dryer section comprising a plurality of second dryer cylinders arranged in series along the path of the web through the second dryer section, a plurality of vacuum transfer rolls, each transfer roll being disposed between adjacent second dryer cylinders of said plurality of second dryer cylinders, and a dryer fabric extending alternately around each second dryer cylinder and each vacuum roll in a manner such that the web is disposed between the fabric and the second dryer cylinder during transit around said second dryer cylinder, and the fabric is disposed between the vacuum roll and the web during transit around said vacuum roll, wherein each of said vacuum transfer rolls defines a upstream dryer and a downstream dryer with respect to each vacuum transfer roll, each vacuum transfer roll being pivotally mounted about a pivot axis which is spaced from the axis of each roll approximately in a vertical cross machine direction plane and thus movable from a first location closely spaced from the upstream dryer to a second location spaced from the first location, said first location being such that there is substantially no down run between the vacuum roll and the preceding upstream dryer cylinder, and said second location being located farther from said preceding upstream dryer cylinder than said first location and closer to said downstream dryer then the first location, and wherein pivoting of the transfer rolls does not result in substantial vertical movement and thus does not cause substantial change in the required length of the dryer fabric.

6. The method of claim 5, wherein the web is transferred from the first drying section to the second drying section at or slightly before the time at which the web attains a moisture content of M, as represented by the formula M=101−0.246(WRV), where M is the percent dryness of the web, and WRV is the water retention value of the web, expressed in percent.

7. The method of claim 5, wherein the web is transferred from the first drying section to the second drying section at or slightly before the time when the web attains a dryness of about 65 percent dry.

8. The method of claim 5, wherein the web is transferred from the first drying section to the second drying section at or slightly before the time when the web attains a dryness of about 75 percent dry.

9. A drying apparatus for drying a web of paper in a papermaking machine, the drying apparatus comprising:

a plurality of first dryer cylinders disposed in a single tier configuration;

a vacuum transfer roll positioned between each two adjacent first dryer cylinders;

a web passing alternately from a first dryer cylinder to a transfer roll and to an adjacent first dryer cylinder;

a dryer fabric which overlies the web as it passes over the first dryer cylinders and which underlies the web as it passes over the transfer rolls, wherein down runs are defined as the web and the dryer fabric extend between the first dryer cylinders and each transfer roll, wherein the dryer fabric defines a pocket bounded by the dryer fabric and vacuum roll between adjacent first dryer cylinders, wherein a partial vacuum is drawn on the pocket to urge the web against the fabric in the down runs;

a plurality of second dryer cylinders positioned downstream of the first dryer cylinders, wherein the web passes from the first dryer cylinders to the second dryer cylinders, a positionable vacuum transfer roll disposed between adjacent second dryer cylinders;

a dryer fabric extending alternately around each second dryer cylinder and each positionable vacuum roll, the dryer fabric defining a required length, the positionable vacuum transfer rolls defining an upstream dryer and a downstream dryer with respect to each vacuum transfer roll, each vacuum transfer roll being pivotally mounted above a pivot axis which is spaced from the axis of each roll approximately in a vertical cross machine direction plane and thus being movable from a first location immediately adjacent to said upstream dryer of said second dryer cylinders and a second location which is spaced further from said upstream dryer and closer to said downstream dryer, wherein pivoting of the transfer rolls does not result in substantial vertical movement and thus does not cause substantial change in the required length of the dryer fabric.

10. The apparatus of claim 9 wherein the number of first dryer cylinders is selected such that the web is transferred from the first dryer cylinders to the second dryer cylinders approximately at which the web attains a moisture content of M, as represented by the formula $M=101-0.246(WRV)$, where M is the percent dryness of the web, and WRV is the water retention value of the web, expressed in percent.

11. The apparatus of claim 9, wherein the number of first dryer cylinders is selected such that the web is transferred from the first dryer cylinders to the second dryer cylinders section at or slightly before the position in the apparatus where the web attains a dryness of about 65 percent dry.

12. The apparatus of claim 9, wherein the number of first dryer cylinders is selected such that the web is transferred from the first dryer cylinders to the second dryer cylinders section at or slightly before the position in the apparatus where the web attains a dryness of about 75 percent dry.

13. A drying apparatus for drying a web of paper in a papermaking machine, the drying apparatus comprising:

a plurality of first dryer cylinders disposed in a single tier configuration;

a vacuum transfer roll positioned between each two adjacent first dryer rolls;

a web passing alternately from a first dryer cylinder to a transfer roll and to an adjacent first dryer cylinder;

a dryer fabric which overlies the web as it passes over the first dryer cylinders and which underlies the web as it passes over the transfer rolls, wherein down runs are defined as the web and the dryer fabric extend between the first dryer cylinders and each transfer roll, wherein the dryer fabric defines a pocket bounded by the dryer fabric and vacuum roll between adjacent first dryer cylinders, wherein air is drawn from the pocket to create a partial vacuum and thus urge the web against the fabric in the down runs;

a plurality of second dryer cylinders positioned downstream of the first dryer cylinders, wherein the web passes from the first dryer cylinders to the second dryer cylinders, a pivotable vacuum transfer roll rotatably mounted to a pivot mount, the pivot mount being mounted to a frame between adjacent second dryer cylinders;

a dryer fabric extending alternately around each second dryer cylinder and each pivotable vacuum roll, the dryer fabric defining a required length, the pivotable vacuum transfer rolls being pivotable from a first location in extreme close proximity to at least one adjacent second dryer cylinder and a second location which is spaced further from said at least one adjacent second dryer cylinder wherein pivoting of the transfer rolls does not result in substantial vertical movement and thus does not cause substantial change in the required length of the dryer fabric.

* * * * *